United States Patent [19]

Polick

[11] Patent Number: 4,819,138

[45] Date of Patent: Apr. 4, 1989

[54] LAMP DESIGN

[76] Inventor: Peter Polick, 20 Cedar St., Yonkers, N.Y. 10701

[21] Appl. No.: 173,821

[22] Filed: Mar. 28, 1988

[51] Int. Cl.[4] ..... F21S 3/02

[52] U.S. Cl. ..... 362/419; 362/427; 362/430

[58] Field of Search ..... 362/418, 419, 427, 430, 362/285, 287, 220; 248/282, 280.1

[56] References Cited

U.S. PATENT DOCUMENTS

| | | | |
|---|---|---|---|
| 1,148,436 | 7/1915 | Blain | 362/418 X |
| 1,591,791 | 7/1926 | Sprout | 362/418 X |
| 2,911,525 | 11/1959 | Strom | 362/418 X |
| 3,188,460 | 6/1965 | Thorsen et al. | 362/418 X |
| 4,449,169 | 5/1984 | Warshawsky | 362/418 X |
| 4,449,172 | 5/1984 | Warshawsky | 362/418 X |
| 4,494,177 | 1/1985 | Matthews | 362/418 X |
| 4,630,185 | 12/1986 | Copelan | 362/419 X |
| 4,706,575 | 11/1987 | Hamlin | 248/282 X |
| 4,726,552 | 2/1988 | Warshawsky | 362/427 X |
| 4,744,019 | 5/1988 | Krogsrud | 362/427 X |

*Primary Examiner*—Ira S. Lazarus
*Assistant Examiner*—Richard R. Cole

[57] ABSTRACT

The present invention is directed to a new and improved design associated with the fabrication and construction of a lamp, the lamp comprising a first base member, a first supporting arm member, a second base member, a second supporting arm member, and an element housing member, the first supporting arm member having one end thereof being mechanically coupled to the base member by a mechanical coupling that allows for omnidirectional movement of the first supporting arm member about the vertical axis of the first base member while the second base member is mechanically coupled to the free end of the first supporting arm member by way of a mechanical coupling that allows for omnidirectional movement of the first supporting arm member in relation to the vertical axis of the second base member while maintaining as constant the orientation of the second base member as related to the first base member. A second supporting arm member is mechanically coupled to the second base member so as to allow for the omnidirectional movement of the second supporting arm member about the second base member. The free end of the second supporting arm member is mechanically coupled to the element housing member by a mechanical coupling that allows for the omnidirectional movement of the element housing member as desired.

6 Claims, 3 Drawing Sheets

LAMP DESIGN

BACKGROUND AND OBJECTS OF THE INVENTION

The present invention relates to a generally new and improved design associated with the fabrication and construction of a lamp capable of providing parallel orientation between the element housing member of the lamp and the first base member of the lamp independent of the movement or adjustment of the lamp structure.

In conjunction therewith and prior to the present invention, lamp designs existed whereby a base member was utilized in combination with supporting arm members, and an element housing member, however, none of the prior art designs incorporating the above elements lended themselves to the advantages and overall efficiencies achievable in conjunction with the present invention.

More particularly, although it was known in the prior art to construct lamps and other devices incorporating, utilizing and implementing components of a similar structure as herein set forth, said prior art being; U.S. Pat. Nos. 899,913 issued on Sept. 29, 1908, to Hugh Robertson Shaw of Rosseau, Ontario, Canada; 1,423,924 issued on July 25, 1922, to Edwin L. Edwards of Indianapolis, Ind.; 1,742,419 issued on Jan. 7, 1930, to Howard A. Selah of Erie, Pa.; 2,249,610 issued on July 15, 1941, to Robert F. James of Mahwah, N.J. and Deryl Hart of Durham, N.C.; 2,548,476 issued on Apr. 10, 1951, to Frederick G. Horstmann of Guildford, England; 4,335,315 issued on June 15, 1982, to Hans Waerve of Sollentuna, Sweden and Sten Djurson of Stockholm, Sweden; 4,437,635 issued on Mar. 20, 1984, to Duc T. Pham of Birmingham, England; 4,460,148 issued on July 17, 1984, to Tadajiro Sasaki of Osaka, Japan, same being representative of the state of the prior art to date, said prior art neither teaches nor discloses the present invention which improves upon and otherwise overcomes many of the disadvantages associated therewith, as well as creating a new and unique lamp design that is distinct therefrom.

More particularly, the present invention directs itself to a new and improved design for a lamp which incorporates and otherwise overcomes many disadvantages associated with prior art devices, said device incorporating within its design and function many features which enable said device to accomplish various objects of the invention as hereinafter set forth.

It is in the context of the above that one of the primary objectives of the invention is to create a new and improved lamp that is capable of maintaining parallel orientation between the lamps element housing member as compared to its base member, such that the lighting element of said lamp retains its relative orientation as compared to the surface of a table or desk upon which said lamp is placed without requiring reorientation of same whenever a supporting arm member of the lamp's structure is moved to otherwise adjust the location of the lighting element relative to a party who is utilizing the lamp for illumination.

It is another object of this invention to create a new and improved design associated with the fabrication and construction of a lamp wherein a self-balancing supporting arm member incorporated in conjunction with a universal joint mechanism is utilized.

It is another object of this invention to create a new and improved design associated with the fabrication and construction of a lamp wherein the mechanical interrelationship to achieve parallel orientation between the element housing member and the base member of the lamp design comprises a structurally sound device capable of simplified fabrication and durability related to the utilization thereof.

The objects and advantages of the invention are set forth in part herein and in part will be obvious herefrom or may be learned by the practice of the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

The present invention is directed to a new and improved design associated with the fabrication and construction of a lamp, said lamp comprising a first base member, a first supporting arm member, a second base member, a second supporting arm member, and an element housing member, the first supporting arm member having one end thereof being mechanically coupled to said base member by a mechanical coupling that allows for omnidirectional movement of the first supporting arm member about the vertical axis of the first base member while the second base member is mechanically coupled to the free end of the first supporting arm member by way of a mechanical coupling that allows for omnidirectional movement of the first supporting arm member in relation to the vertical axis of the second base member while maintaining as constant the orientation of the second base member as related to the first base member. A second supporting arm member is mechanically coupled to the second base member so as to allow for the omnidirectional movement of the second supporting arm member about the second base member. The free end of the second supporting arm member is mechanically coupled to the element housing member by a mechanical coupling that allows for the omnidirectional movement of the element housing member as desired, the interrelationship between the first and second supporting arm members and the first base member and the second base member being such that the element housing member is capable of being mechanically positioned at a variety of locations relative to the first base member, said positioning, however, being such as to maintain a consistent parallel orientation between the first base member and the element housing member.

It will be understood that the foregoing general description and the following detailed description as well are exemplary and explanatory of the invention, but are not restrictive thereof.

The accompanying drawings referred to herein and constituting a part hereof, are illustrative of the invention but not restrictive thereof, and, together with the description, serve to explain the principles of the invention.

DESCRIPTION OF A PREFERRED EMBODIMENT

Figure 1:
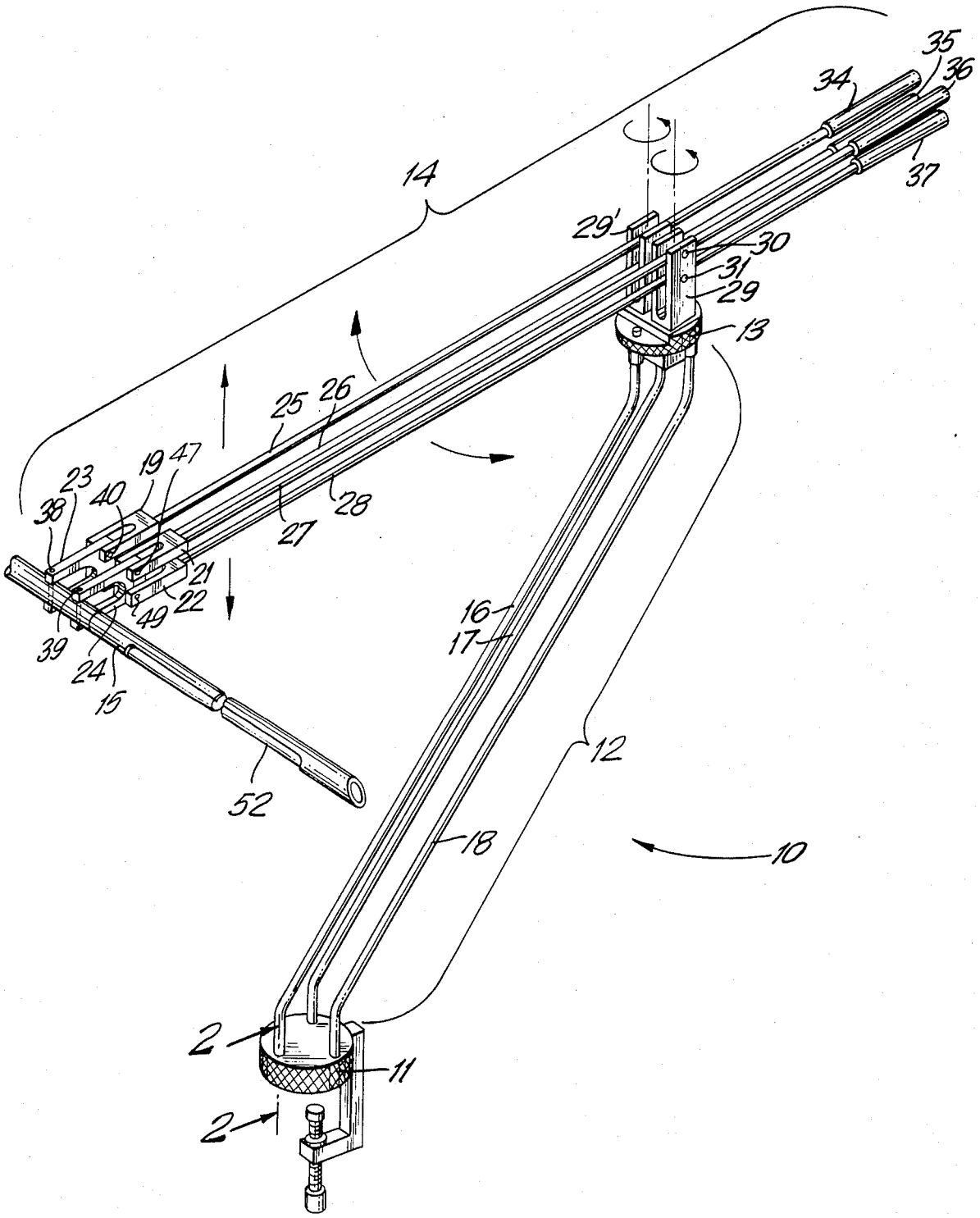
FIG. 1 is a three dimensional perspective view of a lamp constructed in accordance with the invention.

Reference is herein made to FIG. 1 wherein there is depicted a lamp 10 constructed in accordance with the invention. As evidenced in FIG. 1, lamp 10 comprises a first base member 11, a first supporting arm member 12, a second base member 13, a second supporting arm member 14, and a element housing member 15.

In accordance with the invention, it should be noted that first supporting arm member 12 as depicted in FIG. 1 comprises a first rod member 16, a second rod member 17 and a third rod member 18. Said first rod member 16, said second rod member 17, and said third rod member 18 each having each of their respective end portions bent to form identical angles as depicted in FIG. 1, said angular portions of each of said rod members 16, 17 and 18 respectively having axes that are parallel to each other.

In keeping with the invention, each of said rod members 16, 17 and 18 have one of their ends mechanically coupled to said first base member 11 such that the axes of said bent portion of each of said rod members 16, 17 and 18 are perpendicular to the horizontal surface of said first member 11.

Figure 2:
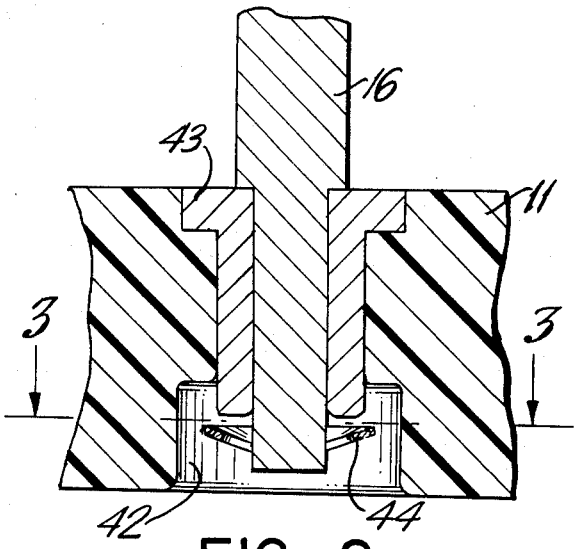
FIG. 2 is a partial, cross-sectional view of a portion of the lamp as depicted in FIG. 1 taken along line 2—2.

Additionally, the mechanical coupling between said rod members 16, 17 and 18 with first base member 11 is such as to permit said rod members 16, 17 and 18 to rotate about the vertical axes thereof as regarding said bent portions of same, the bent portion of said rod members 16, 17, and 18 being in mechanical interfit with a seat housing, there being depicted in FIG. 2 a partial cross sectional view of FIG. 1 taken along line 2—2 wherein there is illustrated one embodiment for the mechanical interfit between rod member 16 as same interfits within first base member 11.

It should be noted that the mechanical interrelationship depicted in FIG. 1 and FIG. 2, evidencing the mechanical structure regarding how rod members 16, 17 and 18 are positioned in mechanical interfit with first base member 11, evidences a mechanical interrelationship well-known within the prior art which permits said rod members 16, 17 and 18 to rotate about their axes as to the bent portions thereof that are mechanically interfitted into said first base member 11 while preventing the removal of said bent portions of said rod member 16, 17 and 18 from said first base member 11.

In accordance with the above, it should be noted that it's well-known within the prior art by way of a variety of known methods to accomplish the mechanical interrelationship between rod member 16, 17 and 18 as related to first base member 11. Reference is herein made to FIG. 2 wherein there is depicted one means to accomplish the above referenced mechanical interfit wherein there is utilized prior art technology and know-how. More particularly, as set forth in FIG. 2, there is depicted a cross-sectional view of first base member 11 at the location where first rod member 16 is in mechancial interfit with said member 11.

As depicted in FIG. 2, there is formed through first base member 11 an opening 42 wherein there is positioned in a manner well-known within the prior art a brass bushing 43 which is cylindrical in shape and defining a hollow opening there through while forming a lip structure at one end thereof so as to be capable of forming a frictional fit into opening 42 formed in first base member 11.

Once brass bushing 43 is positioned in first base member 11 as depicted in FIG. 2, first rod member 16 has the lower bent potion thereof forceably passed through the center opening of brass bushing 43 so as to have a portion thereof extend beyond the dimensions of said brass bushing 43 as depicted in FIG. 2.

Figure 3:
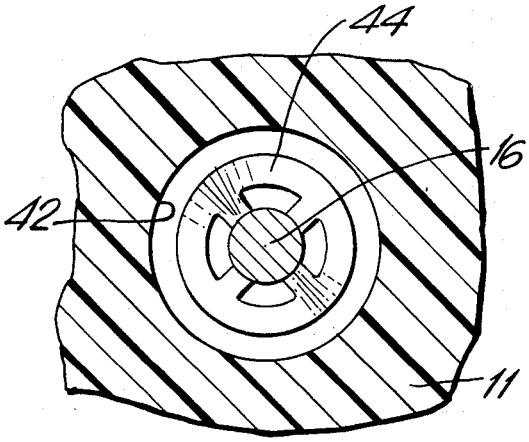
FIG. 3 is a partial, cross-sectional view of a portion of the lamp as depicted in FIG. 2 taken along line 3—3.

By utilizing self-locking retaining ring 44, as depicted in FIG. 3 (which is a partial cross-sectional view taken along line 3—3 of FIG. 1) there is achieved the mechanical interfit between first rod member 16 and first base member 11 referred to above. More particularly, FIGS. 2 and 3 depict one means well-known within the prior art for achieving the mechanical interfit between first rod member 16 and first base member 11 wherein first rod member 16 is permitted to rotate about that portion of its axis that is perpendicular to the surface of first base member 11 while insuring that first rod member 16 cannot be mechanically dislodged from its interfit with first base member 11.

In accordance with the above, it should be noted that other mechanical means well-known in the prior art exist to accomplish the above mechanical interrelationship between first rod member 16 and first base member 11 as referred to above, and nothing herein, should be interpreted as to so limit the present invention to the specific mechanical structure related to such interfit as discussed above and as set forth in FIG. 2 and FIG. 3 of the drawings. In conjunction with the above, it should be noted that although the description set forth above and as depicted in FIG. 2 and FIG. 3 of the drawings only relate to first rod member 16 and its mechanical interfit with first base member 1, same is also applicable to the mechanical interfit between second rod member 17 with first base member 11 and third rod member 18 and first base member 11.

Additionally, it should further be noted that the mechanical interfit described above with regard to said mechanical interfit between first rod member 16 and first base member 11, second rod member 17 and first base member 11 and third rod member 18 with first base member 11 is also applicable to the mechanical interrelationship and/or interfit between first rod member 16 and second base member 13, second rod member 17 and second base member 13 and third rod member 18 and second base member 13.

Furthermore, it should be noted that the positioning and interrelationship between first rod member 16, second rod member 17 and third rod member 18 as related to their respective mechanical interfits with first base member 11 and second base member 13 respectively is such as to provide identical, symmetrical patterns about both first base member 11 and second base member 13 respectively.

Figure 5:
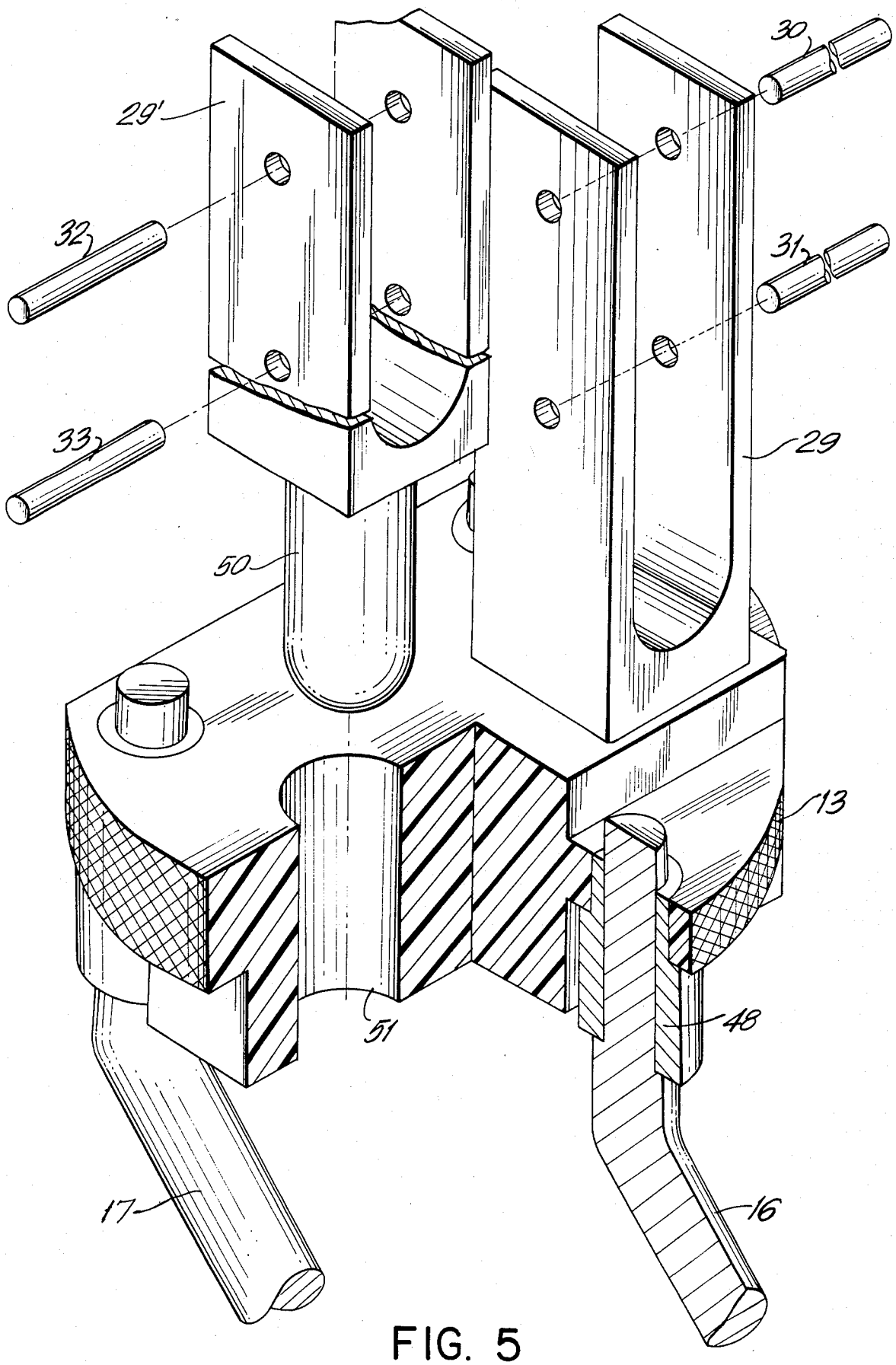
FIG. 5 is a partial cross-sectional perspective view of a portion of the lamp as depicted in FIG. 1.

Reference is herein made to FIG. 5 wherein there is depicted the interfit between the first rod member 16 and second base member 13, same being illustrated in the partial cross-sectional view therein depicted.

As set forth above with regard to the mechanical interfit relationship between first rod member 16 and first base member 11, there is similarly formed an opening through second base member 13 wherein there is positioned in a manner well-known with the prior art a brass bushing 48 which is basically cylindrical in shape and defining a hollow opening there through, said brass bushing 48 being capable of forming a frictional fit within the opening as formed through second base member 13.

Once brass bushing 48 is positioned in second base member 13 as depicted in FIG. 5, first rod member 16 has its upper bent portion thereof forceably passed through the center opening of brass bushing 48 so as to have a portion thereof extend beyond the dimensions of said brass bushing 48 as depicted in FIG. 5.

Although a self-locking retaining ring as described in conjunction with the mechanical interfit depicted in FIG. 2 and FIG. 3 could be utilized about the extended portion of first rod member 16 as it is depicted in FIG. 5 (self-locking retaining ring 44), utilization of such a similar retaining ring as related to the mechanical interfit between first rod member 16 and second base member 13 as depicted in FIG. 5 is not required as illustrated in the present embodiment depicted therein although such a retaining means could be utilized. As with regard to the mechanical interfit between first rod member 16 and second base member 13 as set forth above, identical means to achieve such a mechanical interfit are utilized as between second rod member 17 with second base member 13 and third rod member 18 and second base member 13.

As a result of the above mechanical interrelationships as therein defined, and in keeping with the invention, there is achieved the ability to have second base member 13 positioned about the circumference of a horizontal plane that is perpendicular to the vertical axis of second base member 13, said defined plane being parallel to the horizontal plane encompassing first base member 11, the vertical distance between said plane members being constant and determined by the overall dimensions of first rod member 16, second rod member 17 and third rod member 18 respectively.

Figure 4:
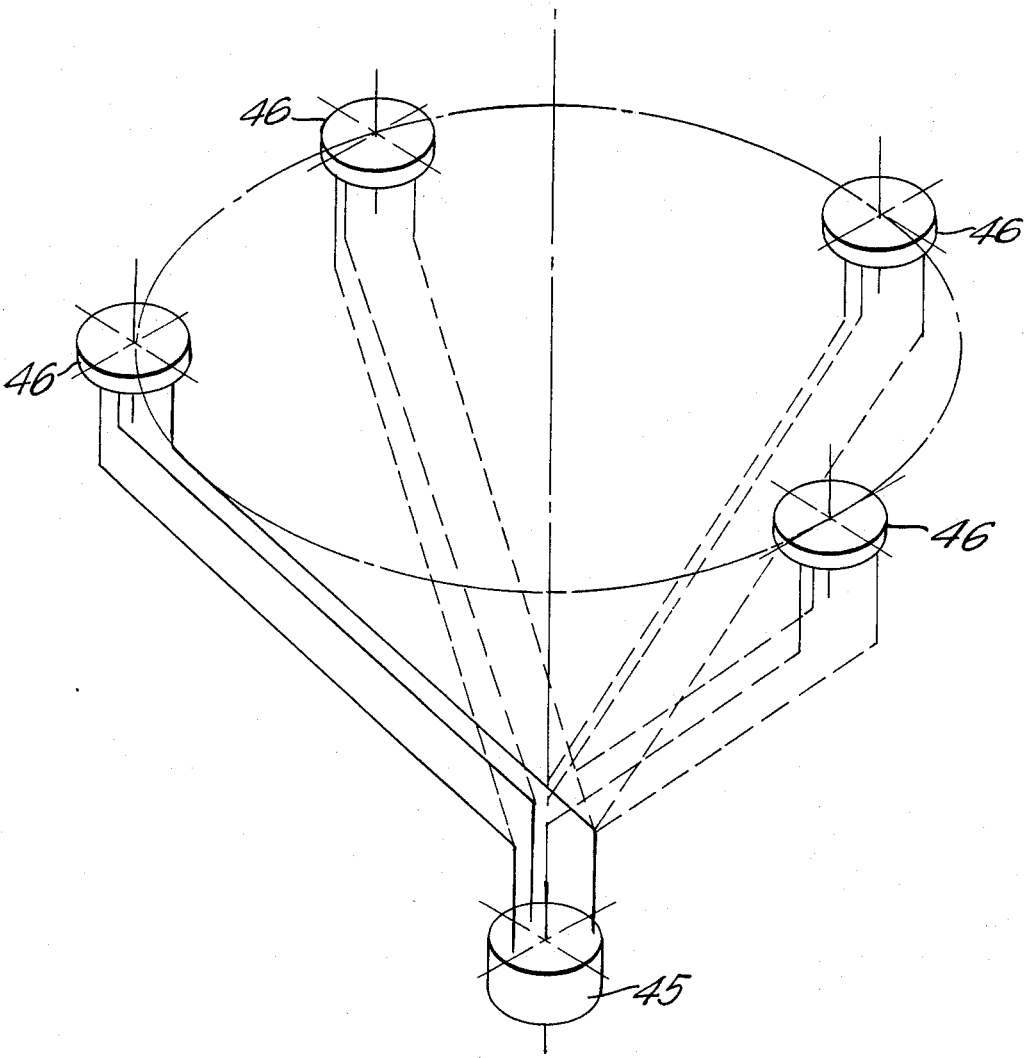
FIG. 4 is a three-dimensional perspective view setting forth the conceptual advantages of the lamp depicted in FIG. 1 in an attempt to illustrate the implementation of the invention's concepts.

Reference is herein made to FIG. 4 wherein there is illustrated the above referenced concepts as related to the mechanical interrelationship between first base member 11 and second base member 13 as defined herein in accordance with the invention.

As depicted in FIG. 4, lower pedestal 45, which corresponds to first base member 11 of FIG. 1, in the implementation of the invention remains in a fixed position while upper pedestal 46, which corresponds to second base member 13 of FIG. 1, can vary as to position within confined parameters an thus is depicted in a variety of locations (as represented by the "dashed lines") confined within a plane parallel to the plane surface of lower pedestal 45 such that the vertical axis of lower pedestal 45 (corresponding to first base member 11) and the vertical axis of pedestal 46 (corresponding to second base member 13) are always parallel to each other independent of the positioning of upper pedestal 46 (corresponding to second base member 13) as related to the lower pedestal 45 (corresponding to first base member 11).

Additionally, due to the orientation and utilization of first rod member 16, second rod member 17 and third rod member 18, there is achieved and otherwise maintained a constant fixed relationship and/or fixed rotational orientation about their respective vertical axes as between lower pedestal 45 (corresponding to first base member 11) and upper pedestal 46 (corresponding to second base member 13). In other words, independent of the positioning of upper pedestal 46 (corresponding to second base member 13) as regarding its location as related to lower pedestal 45 (corresponding to first base member 11), there is always maintained as between same a constant, fixed and identical orientation about their respective vertical axes. By so doing, there is achieved the overall advantages of the invention; namely, that the initial orientation of element housing member 15 in relationship to first base member 11 will not be altered by the fact that second base member 13 and thus the effective overall structure of lamp 11 is repositioned to conform with the desire and/or convenience of a party utilizing lamp 10 as related to a particular set of circumstances. As a result of the above, there is thus achieved the overall ability of lamp 10 to be able to maintain consistent parallel orientation between first base member 11 and element housing member 15.

Although FIG. 1 depicts first supporting arm member 12 as comprising a first rod member 16, a second rod member 17 and a third rod member 18, bent at their respective ends and mechanically intercoupled with first base member 11 and second base member 13, nothing herein contained should be considered to so limit the invention to only such a specific structure. To the contrary, it is within the scope of this invention to utilize any equivalent and/or comparable structure and/or structures as regarding the structure of first supporting arm member 12, be it a singular structural member having a ball and socket arrangement and/or universal joint, and the like, appearing at both ends which in turn provides the mechanical intercoupling with first base member 11 and second base member 13 respectively, or otherwise, or a variation on the structure specifically set forth in FIG. 1 whereby more than said three rod members 16, 17 and 18 are in fact utilized.

The intent of the above is that it is within the scope of this invention to use any equivalent structure in place of first supporting arm member 12 as depicted in FIG. 1 which is capable of accomplishing the same mechanical results as would be the case regarding the above referred to disclosure and that nothing should be interpreted to limit the invention only to the structure depicted in FIG. 1.

In addition to the above, it is within the scope of the invention to have first rod member 16, second rod member 17, and third rod member 18 have a cross-section that defines any one of a number of geometrical shapes, be it circular, rectangular, square, elliptical, hexagonal, and the like, it being specifically understood that the scope of the invention encompasses any variation thereof even though the preferred embodiment depicts a cross-sectional view that defines same as being circular.

In keeping with the invention, and as so illustrated in FIG. 1, second supporting arm member 14 comprises parallel supporting members 25, 26, 27 and 28 respectively, same being positioned to define a parallelogram as illustrated in FIG. 1, said parallel supporting members 25, 26, 27 and 28 being mechanically affixed to pedestal members 29 and 29' by way of pin members 30, 31, 32 and 33 respectively. It should be noted as stated with regard to the cross-sectional shape as to first rod member 16, second rod member 17 and third rod member 18, that the cross-sectional area of parallel supporting members 25, 26, 27 and 28 can be of a cross-section that defines any one of a number of geometrical shapes, be it circular, rectangular, square, elliptical, hexagonal, and the like, there being illustrated in the preferred embodiment as set forth in the drawings the fact that said cross-section thereof defines a circle.

Affixed to the lower portion of said parallel supporting members 25, 26, 27 and 28 are balancing members 34, 35, 36 and 37 respectively, same being capable of offsetting the weight attributable to element housing member 15 and the fluorescent lamp 52 contained therein such that second supporting arm member 14 can be positioned at any level within its range of positioning and remain oriented as originally positioned.

As further illustrated in FIG. 1, parallel supporting members 25, 26, 27 and 28 are structurally affixed to their respective ends opposite to balancing members 34, 35, 36 and 37 respectively to "U" shaped members 19, 20 (hidden in FIG. 1), 21 and 22 respectively. As further depicted in FIG. 1, "U" shaped members 19 and 20 are structurally affixed to "U" shaped member 23 by way of pin members 40 and 41 (pin member 41 being hidden from view in FIG. 1) and as to "U" shaped members 21 and 22 are structurally affixed to "U" shaped member 24 by way of pin members 47 and 49 respectively.

In keeping with the invention, "U" shaped members 23 and 24 are structurally affixed to element housing member 15 by way of pin members 38 and 39 respectively.

Additionally, and in accordance with the invention, parallel supporting members 25 and 26 are structurally affixed to pedestal member 29' by way of pin members 32 and 33 respectively, said pinning arrangement being such as to enable either clockwise or counterclockwise rotational movement of parallel supporting members 25 and 26 respectively about the axis of their respective pin members 32 and 33.

In a similar fashion, and in accordance with the invention, parallel supporting members 27 and 28 are structurally affixed to pedestal member 29 by way of pin members 30 and 31 respectively, said pinning arrangement being such as to enable either clockwise or counterclockwise rotational movement of parallel supporting members 27 and 28 respectively about the axis of their respective pin members 30 and 31.

Additionally, and in accordance with the invention, pedestal member 29' has extended beneath its "U" shaped configuration plug member 50 capable of structural interfit with plug opening 51 which is formed through second base member 13 as illustrated in FIG. 5. As illustrated in FIG. 5, block member 50 structurally interfits with block opening 51 so as to enable the rotational movement of pedestal member 29' about the axis of plug opening 51 either in a clockwise or counterclockwise fashion, pedestal member 29 being structurally identical to that to pedestal member 29' inclusive of having its own plug member equivalent to plug member 50 and capable of structural interfit within plug opening formed through second base member 13 comparable to plug opening 51. Additionally, pedestal member 29 is capable of the same rotational movement as described with regard to pedestal member 29.

As can be seen from the above and, in particular, review of FIG. 1, there is achieved as a result of the above defined embodiment, a lamp capable of maintaining a specific pre-determined orientation between its illuminating element and the surface that is to be illuminated independent of the positioning of the lamp structure.

In keeping with the invention, and as illustrated in FIG. 1, the interrelationship therein defined as regarding parallel supporting members 25, 26, 27 and 28 as achieved through the mechanical pinning relationship of same as related to pedestal members 29 and 29', along with the mechanical interplay between parallel supporting members 25, 26, 27 and 28 and "U" shape members 19, 20, 21, 22, 23 and 24, as related to element housing member 15, results in there being achieved the fact that element housing member 15 remains in a constant axial orientation independent of the elevational positioning of second supporting arm member 14. It should also be noted that element housing member 15 shall remain parallel to its initial setting as related to first base member 11 independent of the positioning of second supporting arm 14 as related to the clockwise or counter-clockwise movement thereof about the vertical axis of second base member 13.

As should be obvious from the above, that by implementing the various design criteria set forth with regard to the invention as herein disclosed, there is achieved the ability whereby the orientation of element housing member 15 is maintained in a consistent parallel orientation between itself and first base member 11 independent of the placement thereof.

The preceding description and accompanying drawings relate primarily to a specific embodiment of the invention, and the invention in its broader aspect should not be so limited to one specific embodiment as herein shown and described, but departures may be made therefrom within the scope of the accompanying claims without departing from the principals of the invention and without sacrificing its chief advantages.

I claim:

1. A lamp capable of placement upon a planar surface wherein the illumination element of said lamp is selectively positionable above said planar surface while retaining its orientation with regard to said planar surface independent of the location of said illumination element above said planar surface, said lamp comprising:

(a) a first base member;

(b) a first supporting arm member, said first supporting arm member having an upper portion and a lower portion, said lower portion being structurally affixed to said first base member so as to allow for arced movement of said first supporting arm member about said first base member;

(c) a second base member, said second base member being structurally affixed to the upper portion of said first supporting arm member so as to allow for the selective positioning of said second base member relative to said first base member while maintaining as a constant the axial orientation of said second base member relative to said first base member;

(d) a second supporting arm member structurally affixed to said second base member comprising four parallel supporting members each having affixed at one of their respective end portions balancing members while having "U" shaped members structurally affixed to each of said parallel supporting members at their respective other end portions; and (e) an element housing member structurally affixed to said second supporting arm member.

2. A lamp capable of placement upon a planar surface wherein the illumination element of said lamp retains its orientation with regard to said planar surface independent of the location of said illumination element above said planar surface, as described in claim 1, wherein said first supporting arm member comprises three parallel rod members each defining an upper portion and a lower portion, said lower portion of each of said parallel rod members being structurally affixed to said first base member but capable of arced movement about the axis of said first base member while the upper portion of each of said parallel rod members is structurally affixed to said second base member but capable of arced movement about the axis of said second base member.

3. A lamp capable of placement upon a planar surface wherein the illumination element of said lamp retains its orientation with regard to said planar surface independent of the location of said illumination element above said planar surface, as described in claim 1, wherein said first supporting arm member comprises four parallel rod members.

4. A lamp capable of placement upon a planar surface wherein the illumination element of said lamp retains its orientation with regard to said planar surface independent of the location of said illumination element above said planar surface, as described in claim 1, wherein said first supporting arm member comprises five parallel rod members.

5. A lamp capable of placement upon a planar surface wherein the illumination element of said lamp retains its orientation with regard to said planar surface independent of the location of said illumination element above said planar surface, as described in claim 1, wherein each of said four parallel supporting members are structurally affixed to said second base member by means of a first pedestal member and a second pedestal member, said parallel supporting members each being structurally affixed to said first pedestal member and said second pedestal member respectively by means of a pin member.

6. A lamp capable of placement upon a planar surface wherein the illumination element of said lamp retains its orientation with regard to said planar surface independent of the location of said illumination element above said planar surface, as described in claim 1, wherein there is structurally affixed to said first base member a clamping means capable of structurally affixing to a planar surface said first base member.

* * * * *